US006814540B2

(12) United States Patent
Sishtla et al.

(10) Patent No.: US 6,814,540 B2
(45) **Date of Patent: *Nov. 9, 2004**

(54) ROTATING VANE DIFFUSER FOR A CENTRIFUGAL COMPRESSOR

(75) Inventors: Vishnu M. Sishtla, Manlius, NY (US); Thomas M. Zinsmeyer, Pennellville, NY (US)

(73) Assignee: Carrier Corporation, Farmington, CT (US)

( * ) Notice: Subject to any disclaimer, the term of this patent is extended or adjusted under 35 U.S.C. 154(b) by 84 days.

This patent is subject to a terminal disclaimer.

(21) Appl. No.: 10/277,861

(22) Filed: Oct. 22, 2002

(65) Prior Publication Data

US 2004/0076513 A1 Apr. 22, 2004

(51) Int. Cl.[7] ..... F04D 29/46
(52) U.S. Cl. ..... 415/150; 415/148
(58) Field of Search ..... 415/148, 150, 415/159, 160, 161, 163–166

(56) References Cited

U.S. PATENT DOCUMENTS

| | | | | | |
|---|---|---|---|---|---|
| 2,996,996 | A | | 8/1961 | Jassniker | |
| 3,362,625 | A | | 1/1968 | Endress | |
| 3,495,921 | A | * | 2/1970 | Swearingen | 415/163 |
| 3,799,694 | A | * | 3/1974 | Duzan | 415/161 |
| 3,992,128 | A | * | 11/1976 | Lunsford et al. | 415/161 |
| 4,325,673 | A | * | 4/1982 | Hall, Jr. | 415/164 |
| 4,338,063 | A | * | 7/1982 | Nakanishi | 415/164 |
| 4,355,953 | A | * | 10/1982 | Nelson | 415/164 |
| 4,378,194 | A | | 3/1983 | Bandukwalla | |
| 4,657,476 | A | * | 4/1987 | Berg | 415/164 |
| 5,683,223 | A | | 11/1997 | Harada et al. | |
| 5,807,071 | A | | 9/1998 | Brasz et al. | |
| 6,547,520 | B2 | * | 4/2003 | Zinsmeyer et al. | 415/150 |

FOREIGN PATENT DOCUMENTS

| | | | | |
|---|---|---|---|---|
| GB | 2193256 A | * | 2/1988 | 415/164 |
| JP | 58-185999 A | * | 10/1983 | 415/150 |
| JP | 58-197500 A | * | 11/1983 | 415/150 |

* cited by examiner

*Primary Examiner*—Christopher Verdier
(74) *Attorney, Agent, or Firm*—Wall Marjama & Bilinski LLP

(57) ABSTRACT

A vaned diffuser for a centrifugal compressor has provision for selectively adjusting the pitch of the vanes in order to accommodate variable load conditions. Each of the vanes is rotatable about a pivot pin near its leading edge and is engaged with an actuation member near its trailing edge. The actuation members are attached to a common ring which can be selectively rotated to move to the vanes in unison. The ring is supported by rollers at its outer periphery and is positioned at the outer periphery of a diffuser wall such that there is no forward facing step projecting into the flow stream. A throat is defined between adjacent vanes, and the pivot pin for each vane is located downstream of the throat on the pressure side of the vane to reduce turbulence in the flow at the throat.

23 Claims, 7 Drawing Sheets

ROTATING VANE DIFFUSER FOR A CENTRIFUGAL COMPRESSOR

BACKGROUND OF THE INVENTION

The present invention relates generally to centrifugal compressors and, more particularly, to a diffuser structure for centrifugal compressors.

One of the major problems arising in the use of centrifugal vapor compressors is that of maintaining flow stabilization when the compressor load varies over a wide range. The compressor inlet, impeller and diffuser passages must be sized to provide for the maximum volumetric flow rate. Accordingly, when there is a relatively low volumetric flow rate through such a compressor, the flow becomes unstable in the following manner. As the volumetric flow rate is decreased from a stable range, a range of slightly unstable flow is entered. In this range, there occurs a partial reversal of flow in the diffuser passage, creating noises and lowering the compressor efficiency. Below this range, the compressor enters what is known as surge, wherein there are complete flow reversals in the diffuser passage, destroying the efficiency of the machine and endangering the integrity of the machine elements. Since a wide range of volumetric flow rates are desirable in most compressor applications, numerous modifications have been suggested to improve flow stability and machine efficiencies at low volumetric flow rates.

In U.S. Pat. No. 3,362,625, a vaneless diffuser is provided with flow restrictors which serve to regulate the flow within the diffuser in an effort to improve stability at low volumetric flow rates. In U.S. Pat. Nos. 2,996,996 and 4,378,194, there are described variable width vane diffusers wherein the diffuser vanes are securely affixed, as by bolting, to one of the diffuser walls. The vanes are adapted to pass through openings formed in the other wall, thus permitting the geometry of the diffuser to be changed in response to changing load conditions. Although a vaned diffuser is preferred over a vaneless diffuser because a vaned diffuser is more efficient at design incidence than a vaneless diffuser, the variable width vane diffusers presented a number of problems, particularly in regard to the manufacture, maintenance and operation of the machine. Such problems were overcome in the vaned diffuser shown in U.S. Pat. No. 5,807,071, wherein a pair of interconnected rings are provided to jointly define the flow passages which can be selectively varied by rotating one of the rings.

Another approach to a variable vaned diffuser is that shown in U.S. Pat. No. 5,683,223, wherein the individual vanes are selectively rotated in unison by way of a mechanism connected thereto to thereby accommodate the variable load conditions. Generally, such an arrangement is problematic in two respects. First, it is difficult to obtain the precise control that is needed in order to maintain uniformity in the positioning of the individual vanes. That is, for example, if it is desired that all vanes are closed, any inaccuracies in the positioning mechanism may well allow one or more of the vanes to be in a partially open position, thereby introducing inefficiencies that are undesirable. These nonuniformities are further complicated by the existence of various tolerances and the wear of components that are typical of such machines. Secondly, the substantial forces that are exerted on the leading edges of such variable position vanes, tend to cause vibration of the leading edges thereof to thereby affect dynamic stability. In order to control and or eliminate these vibrations it is necessary to provide a very strong, durable and stable vane positioning mechanism which is designed with these considerations in mind.

Although there are some prior art vaned diffusers which provide for the variable blade angle by rotation about a pivot point, the positioning of the pivot pin has not been optimized for best performance of the diffuser.

SUMMARY OF THE INVENTION

The object of the present invention is to provide, in a centrifugal compressor, a vaned diffuser, with the vanes being variably positioned and selectively controlled in order to effectively and accurately vary the pitch of the vanes in order to accommodate the variable load levels in the compressor.

In a preferred embodiment, a vane mounting means is provided with each vane having a pivot pin disposed near its leading edge and acting to position its vane, an actuation mechanism engaging each of the vanes near its trailing edge and operable to rotate the vane on the axis of its pivot pin, and a slot in each of the vanes to allow for relative movement between the vane and mounting means when they are relatively rotated. Such an arrangement provides for a positive and accurate positioning of the vanes so as to maintain a stable flow of gases therethrough.

In accordance with another aspect of the invention, the actuation mechanism includes a shaft and an associated eccentric cam surface which engages said vane, with the shaft being rotatable to cause the vane to rotate.

By another aspect of the invention, the pivot pin is integral with the vane.

By yet another aspect of the invention, the slot is located near the trailing edge of the vane and the cam surface is disposed in the slot.

In accordance with another aspect of the invention, the pivot pin is disposed in the slot.

In accordance with another aspect of the invention, the cam surface is round and is mounted in a round opening in the vane.

By another aspect of the invention, the actuation mechanism includes a ring which is interconnected to each of the vanes by way of actuation pins, and means for rotating the ring to move the vanes in substantial unison.

In accordance with another aspect of invention, the actuation pins are integral with the rotatable ring and are disposed in the openings formed in the vanes.

By yet another aspect of the invention, the vane openings are elongated to allow reciprocal movement between the actuation pins and the vanes.

By still another aspect of the invention, the actuation pins are integral with the vanes and are disposed in openings in the rotatable ring.

By yet another aspect of the invention, the location of the pivot pin has been optimized to reduce performance losses that would otherwise occur at the throats of the flow channels.

The above and other objects, features and advantages of the present invention will become clear from the following description of the preferred embodiments considered in conjunction with the accompanying drawings.

DESCRIPTION OF THE PREFERRED EMBODIMENT

Figure 1:
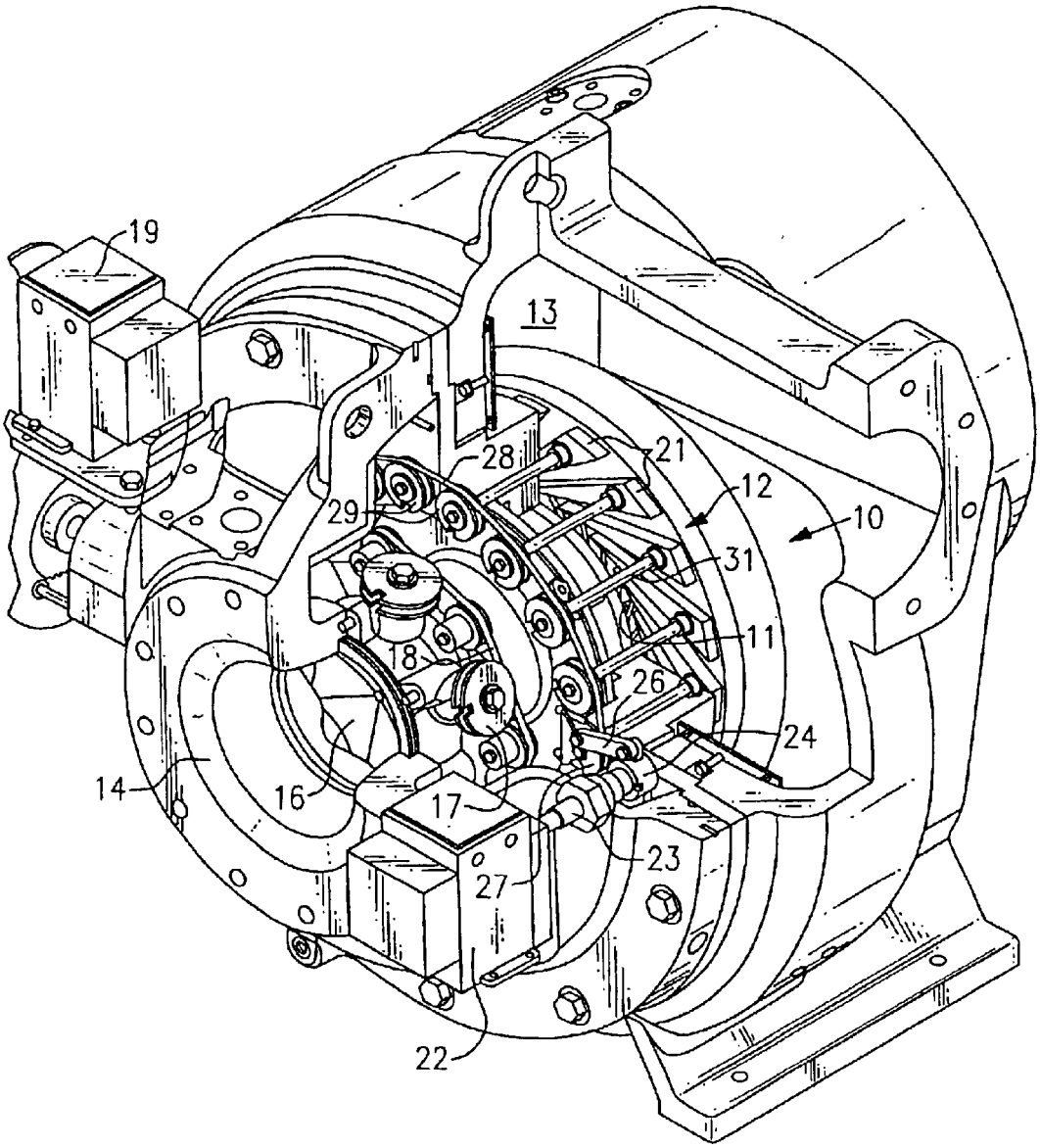
FIG. 1 is a perspective view of a centrifugal compressor with one embodiment of the present invention incorporated therein.

Referring to FIG. 1, the invention is shown generally at 10 as incorporated into a centrifugal compressor having an impeller 11 for compressing refrigerant gas to a high-pressure, high kenetic energy state, after which it passes to the diffuser 12 where the kenetic energy is converted to potential energy or static pressure, and finally it is passed to the collector 13 where the pressure is caused to become uniform prior to entering the discharge line.

Initially, the refrigerant is caused to enter the suction housing 14 and to pass through the inlet guide vanes 16. The flow volume is selectively controlled in a rather conventional manner by adjustment of the pitch of the inlet guide vanes 16 by way of pulleys 17 and cables 18 as driven by a drive motor 19. In a similar but unconventional manner, the pitch of the diffuser vanes 21 are selectively varied by an actuation mechanism which includes a drive motor 22 and crank linkage which includes a drive shaft 23, a collar with an actuation arm 24, a linkage arm 26, and a drive pulley 27. In operation, the drive motor 22 selectively rotates the drive shaft 23 along with the collar 24 so as to thereby cause the linkage arm 26 to translate and rotate the drive pulley 27 to which it is connected. The rotation of the drive pulley 27 causes the cable 28 to move because of the mechanical engagement therewith, and the other pulleys 29 are then caused to rotate in unison with the drive pulley 27. Since each pulley 29 is connected to an actuation shaft 31, a rotation of the pulleys 29 causes rotation of the actuation shafts 31, which will bring about a movement of the diffuser vanes 21 in a manner to be more fully described hereinbelow.

It should be recognized that the pulley and cable drive arrangement shown and described herein is merely one of many approaches that can be employed for the purpose of actuating the vane movement mechanism and should therefore be considered merely a simple mechanical representative of the many possibilities which could include various alternatives of mechanical, hydraulic or electrical drive systems, for example. A rack and pinion drive arrangement will later be described as a preferred mechanical approach.

Figure 2:
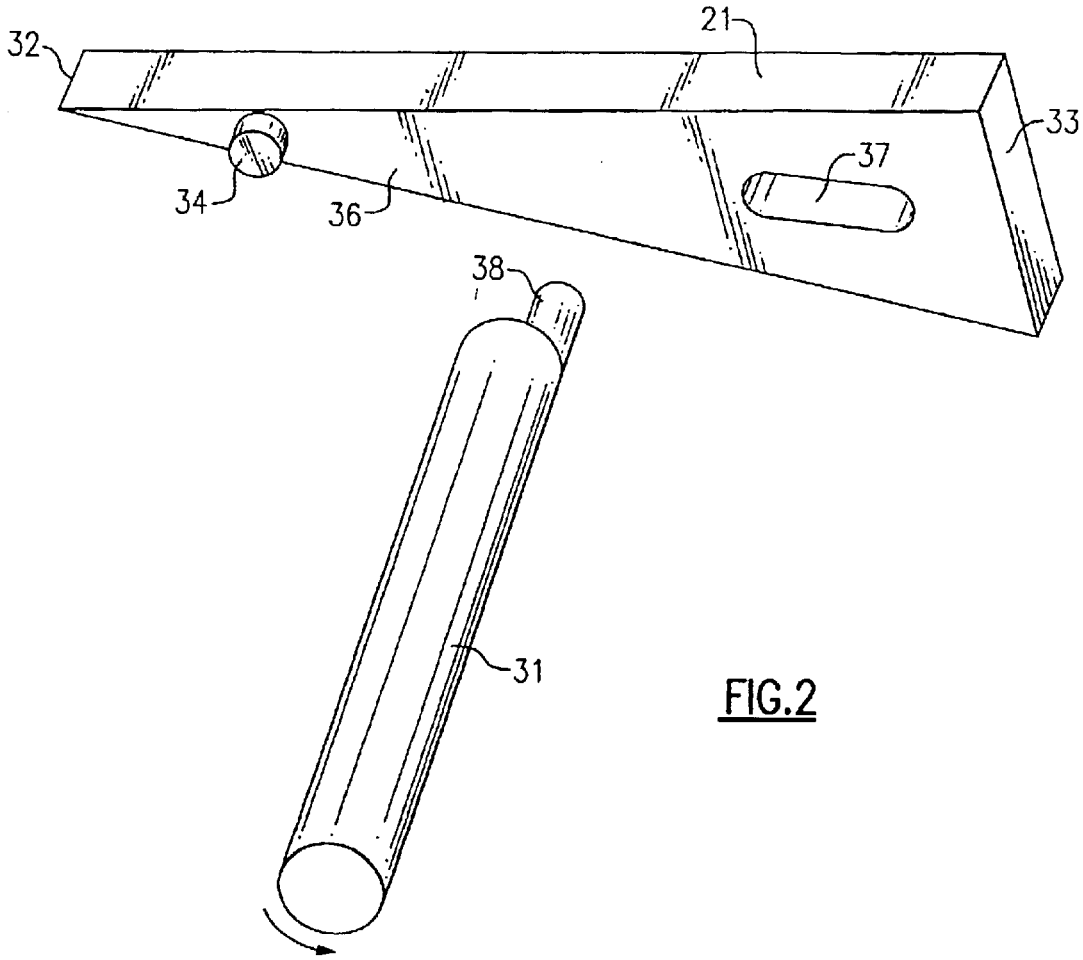
FIG. 2 is an exploded perspective view of the vane and cam portion thereof in accordance with the preferred embodiment.

Referring now to FIG. 2, the diffuser vane 21 and actuation shaft 31 are shown in greater detail. For simplicity, the diffuser vane 21 is shown to be triangular in shape but in actuality would be optimized for aerodynamic performance and would therefore be generally triangular in shape but could be of various specific shapes. It has a leading edge 32 and a trailing edge 33, with the fluid flow on either side of the vane 21 flowing from the leading edge 32 toward the trailing edge 33. Located near the leading edge 32 is a pivot pin 34 extending outwardly from one side 36 thereof for mounting and positioning of the vane 21. In the preferred embodiment, the pivot pin 34 is rotatably mounted on a fixed axis so as to permit a rotary movement of the vane 21 about the axis in a manner to be more fully described hereinafter.

Located near the trailing edge 33 of the vane 21 is a slot 37 extending along a longitudinal plane extending between the leading edge 32 and the trailing edge 33. The actuation shaft 31 has an offset pin 38 extending eccentrically from its one end as shown. With the offset pin 38 installed in the slot 37, rotation of the actuation shaft 31 causes a side-to-side movement of the trailing edge 33, with any relative movement between the offset pin and the vane 21 being accommodated by the longitudinal movement of the offset pin 38 within the slot 37. The forward placement of the pivot pin 34 as shown provides for dynamic stability with minimal vibration at the leading edge 32 of the vane 21. Clearance and alignment problems are minimized by the fact that the actuation shaft 31 is designed to engage, but is not attached to, the vane 21. Finally, the cam action of the offset pin 38 makes it possible to make minute adjustments in the vane position since relatively large rotational movements of the actuation shaft 31 are required in order to effect relatively small rotational movements of the vane 21.

Figure 3A:
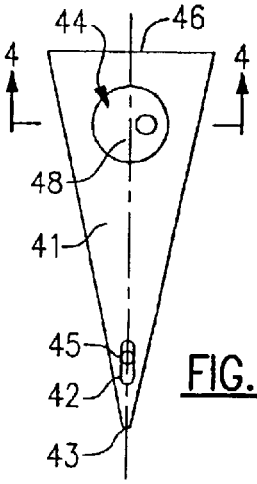
FIGS. 3A and 3B show an alternative embodiment of the vane and cam member thereof.
Figure 3B:
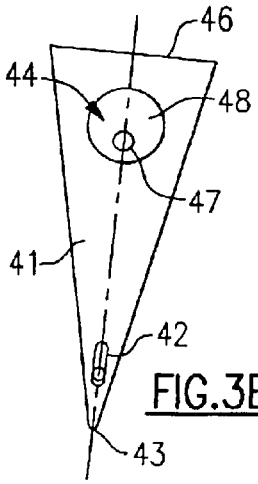
Figure 4:
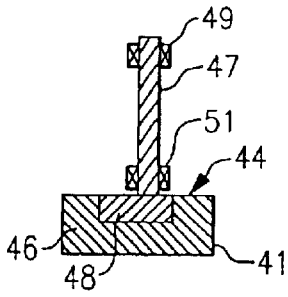
FIG. 4 is a sectional view of the vane and cam members as seen along lines 4—4 of FIG. 3A.

An alternative embodiment of the vane and its associated mounting and actuation means is shown in FIGS. 3 and 4. Here, the vane 41 has a longitudinally extending slot 42 located near the leading edge 43 of the vane 41, and a circular opening 44 located near the trailing edge 46 thereof. The mounting arrangement includes a fixed pivot pin 45 that fits into the slot 42 such that the vane 41 can rotate about its axis. The actuation mechanism includes a rotatable shaft 47 which has a disk 48 rigidly attached to its end in an eccentric manner as shown. A rotation of the shaft 47 within its bearings 49 and 51 causes a rotation of the disk 48 within the circular opening 44 so as to thereby bring about a rotation of the vane 41 about the axis of the pivot pin 45. Any radial movement of the vane 48 disk caused by the eccentric action of the disk 44 will be accommodated by the longitudinal movement of the pivot pin 45 within the slot 42. Although the slot 42 is shown to be linear and longitudinally aligned in form, it may be angled from the longitudinal direction or even curved in order to optimize the control of the leading edge 43.

Figure 5:
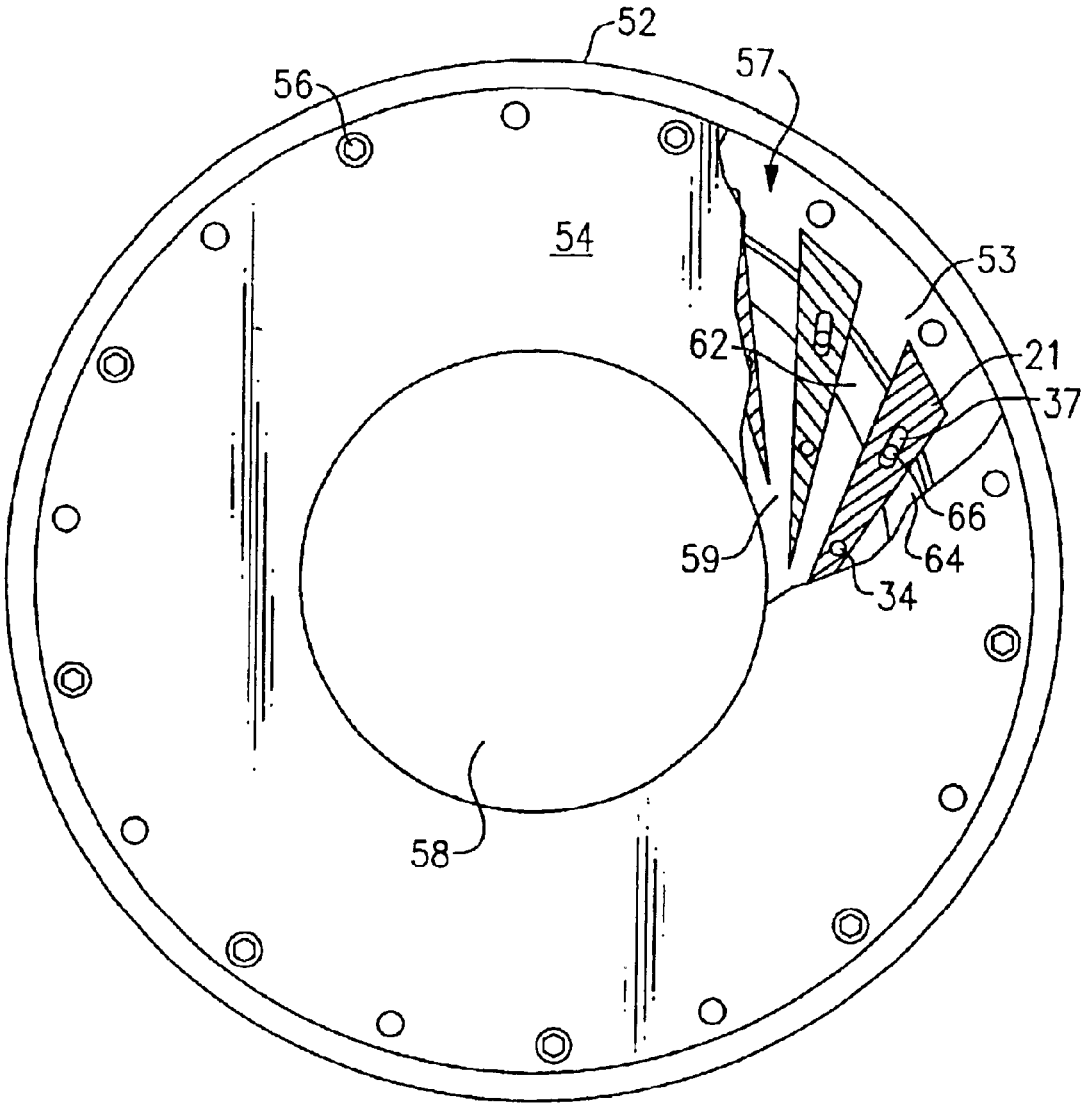
FIG. 5 is a partial cut-away view of the vanes and actuation ring thereof in accordance with the preferred embodiment.
Figure 6:
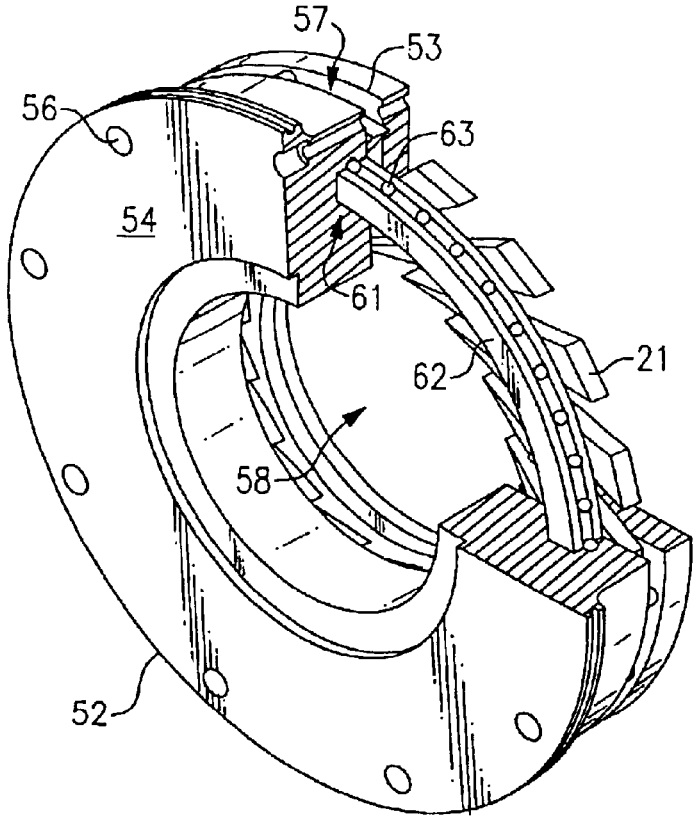
FIGS. 6 and 7 are front and rear perspective views thereof.
Figure 7:
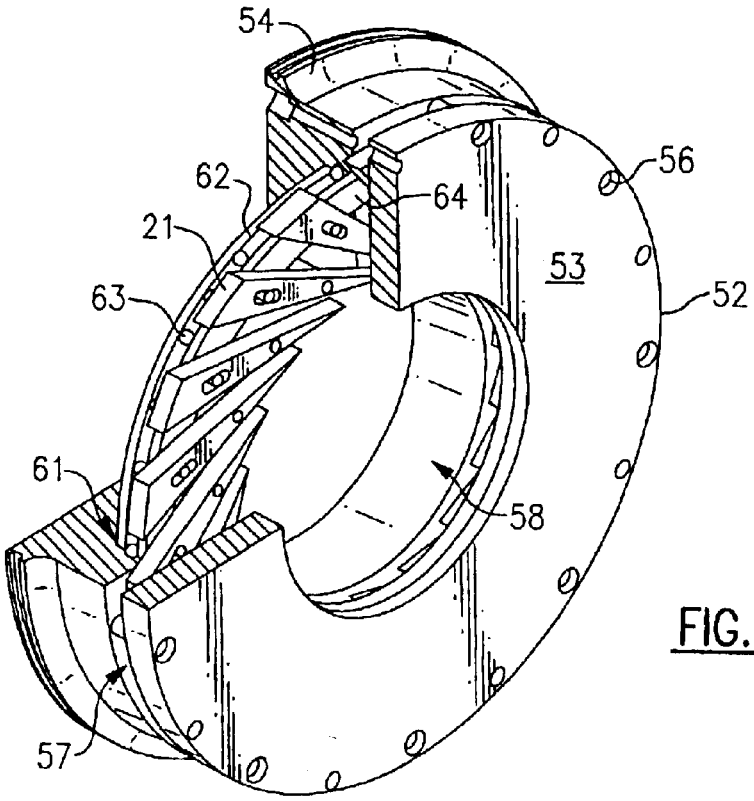

Returning now to the preferred embodiment, reference is made to FIGS. 5–7 wherein more detail is shown with respect to the actuation system for varying the pitch of the vanes. A diffuser housing 52 is made up of a pair of annular components, a flange plate 53 and a bearing ring 54 fastened together by a plurality of bolts 56 and spacers (not shown) in spaced relationship such that a diffuser channel 57 is defined therebetween for locating the diffuser vanes 21 and for conducting the flow of fluid which flows radially outwardly from the impeller (not shown) mounted in a central opening therein. Rigidly attached to and extending from an inner surface 59 of the flange plate 53 are a plurality of pivot pins 34 on which the diffuser vanes 21 are rotatably mounted. The clearance between the pivot pins 34 and the openings in the vanes 21 are sufficient to permit easy rotation of the vanes on the pivot pins 34 but not so great as to allow for any significant translational or vibrational movement between the components.

The bearing ring 54 has an annular channel 61 formed therein for rotatably receiving a coordinating ring 62 therein (see FIGS. 6 and 7), with bearings 63 being provided for smooth and easy rotation of the ring 62. One side 64 on the ring 62 has a plurality of circumferentially spaced actuation pins 66 extending therefrom for engagement with the respective slots 37 of the diffuser vanes 21 (see FIGS. 5 and 7). A rotation of the ring 62 therefore causes all of the vanes 21 to uniformly change their pitch by rotating about the respective axes of their pivot pins 34. During such rotation, the actuation pins 66 will move in the radial direction with respect to their respective vanes, and this relative movement is accommodated by the movement of the actuation pins 66 within their respective slots 37.

It should be recognized that, because the coordinating ring 62 is mounted internally within the diffuser, and is closely coupled to the vanes 21 in a very simple, robust, and cost-effective manner as described, the potential for wear, looseness and inaccuracies in the positional control of the vanes is minimized. Further, because the motion of the pins and the vanes closely approximate each other, sliding motion is minimized, and the adjustment of individual vanes is made unnecessary, thereby making the mechanism easy to assemble and service.

Figure 8:
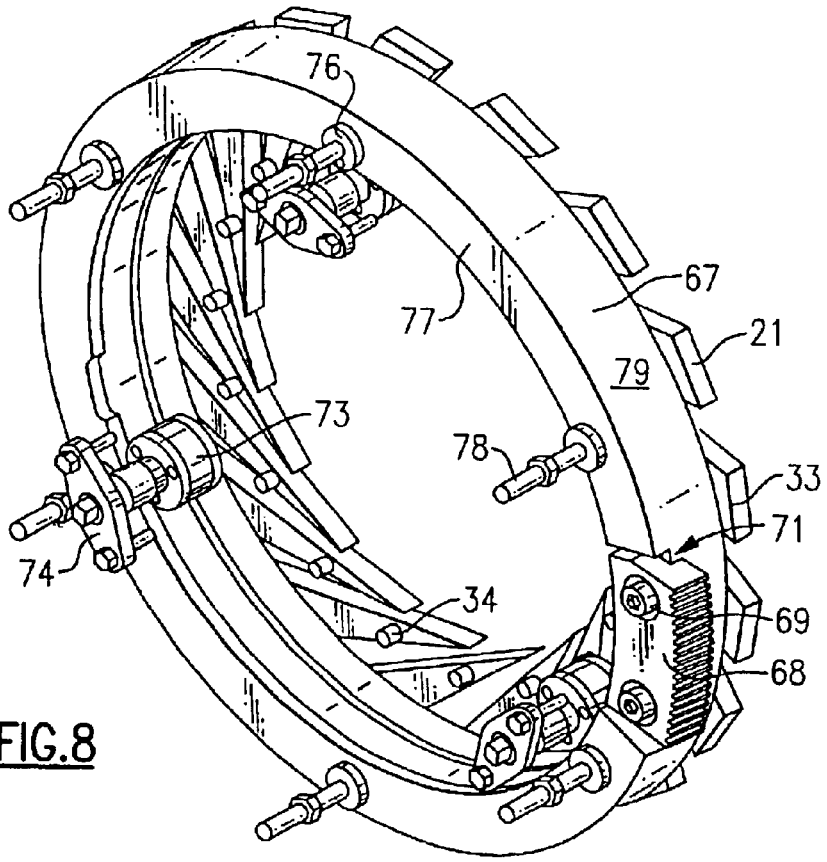
FIG. 8 is a schematic illustration of a side view of the present invention as installed in a centrifugal compressor in accordance with the preferred embodiment.
Figure 10:
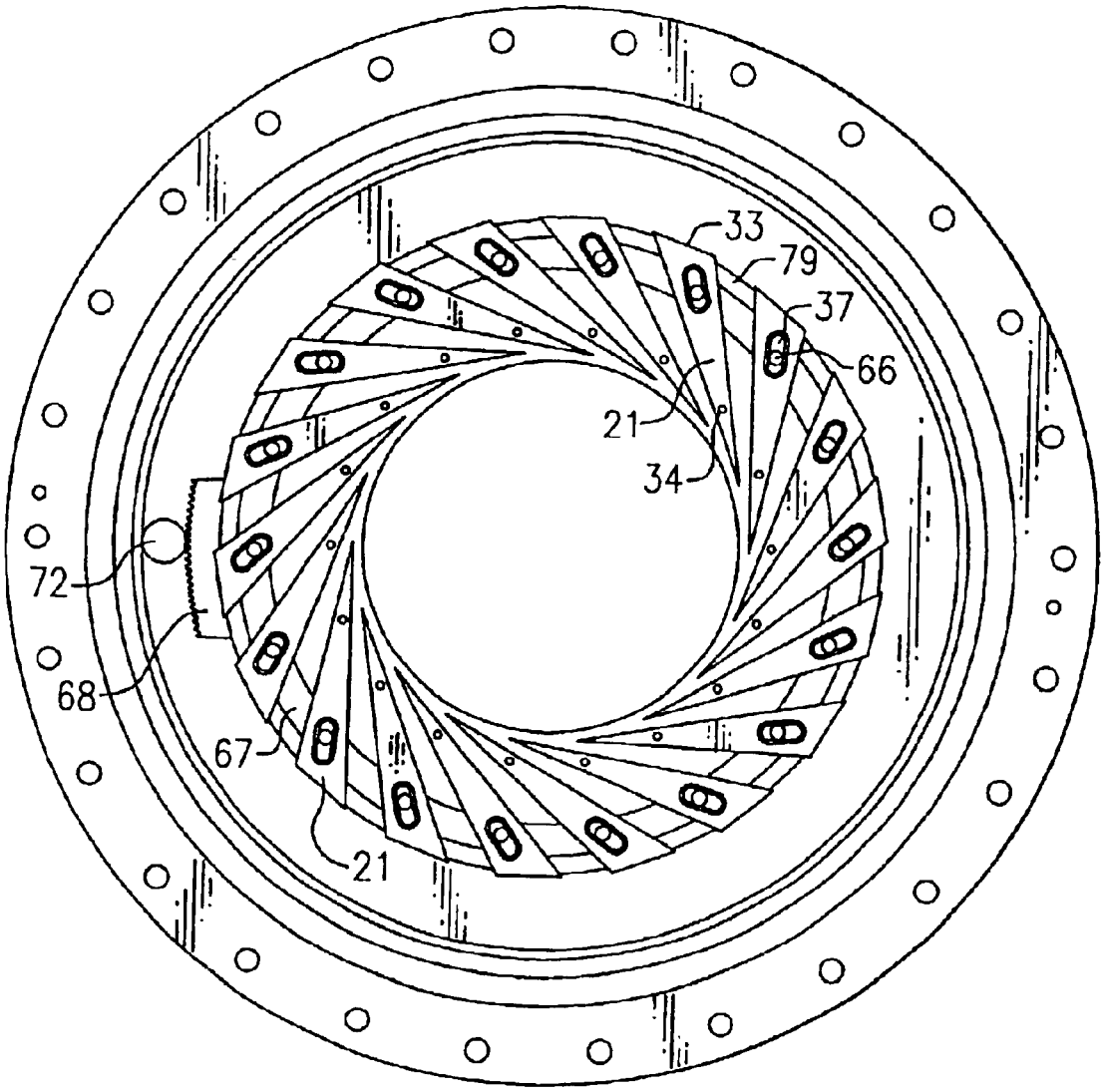
FIG. 10 is an axial view of the diffuser vanes as mounted within the system.

Turning now to a preferred approach as to how the coordinating ring is selectively made to rotate, a coordinating ring is shown at 67 in FIG. 8 to include a gear rack 68 secured by bolts 69 to the indent 71 of the coordinating ring 67. The rack is operably engaged with a pinion 72 as shown in FIG. 10, with the pinion 72 being driven by the drive motor 22 and drive shaft 23 as shown in FIG. 1. The coordinating ring 67 is supported by three circumferentially spaced rollers 73 disposed at its inner diameter and being rotatably secured to the machine framework by securing apparatus 74 as shown in FIG. 8. Axial support of the coordinating ring 67 is provided by a plurality of circumferentially spaced pads 76 which frictionally engage one side 77 of the coordinating ring 67. The positioning of the pads 76 is fine-tuned by the adjusting threaded shaft 78 to enable a proper positioning and axial support of the coordinating ring 67.

Figure 9:
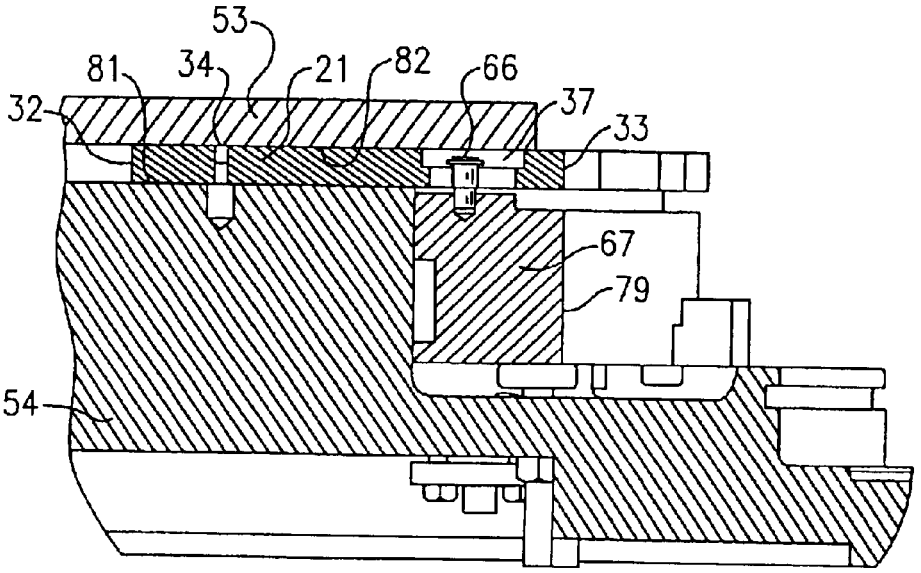
FIG. 9 is a sectional view of a vane and its mounting mechanism.

Before going into further details of the present invention, it would be well to revisit the design as shown in FIGS. 6 and 7. There, the coordinating ring 62 is disposed in an annular channel 61 of the bearing ring 54. If the dimensioning of the components and the fit of one within the other is precise, then there is no problem with respect to the loss of efficiency because of drag that may be caused by a forward facing member. However, if one of the components has an edge that extends axially into the stream of fluid flow as it passes radially outwardly, then the efficiency will be reduced. For example, if the forward face (i.e. the face not seen in FIG. 6 but seen in FIG. 7) of the coordinating ring 62 extends axially beyond the forward face of the bearing ring 54, then its radially inner edge will be projecting into the flow stream to provide an unnecessary restriction to the flow. If, on the other hand, the forward face of the coordinating ring 62 does not extend as far forward as the corresponding face of the bearing ring 54, then the radially outer edge of the annular channel 61 will be exposed to the flow stream. This problem is overcome by the design of FIGS. 8–10 wherein the coordinating ring 67 is not recessed within an annular channel 61 as shown in FIG. 6, but is rather located radially outwardly at the outer edge of the bearing ring 54 as shown in FIGS. 9 and 10. Here, as will be seen, there is no surrounding portion of the bearing ring 54 structure that can affect the performance as described hereinabove. Accordingly, in order that the coordinating ring 67 may not extend axially beyond the face of the bearing ring 54 so as to create the problem as described hereinabove, it is deliberately made with a smaller axial thickness as shown in FIG. 9 so that it will never project into the flow stream. The problem that this would have created with the FIG. 6 design, as described above, is alleviated since there is no bearing ring structure which can project into the flow stream. Such an arrangement also simplifies the machining process as compared with that required for the annular channel 61 of FIG. 6. As will be seen in FIG. 9, as a result of the coordinating ring 67 being located radially outwardly, the radially outer surface 79 of the coordinating ring 67 is also preferably substantially radially aligned with the trailing edges 33 of the vanes 21.

Another feature of the present invention relates to the positioning of the pivot pin 34 for each of the vanes 21. Referring to FIG. 9, it will be seen that each of the vanes 21 is located between a front wall 81 of the bearing ring 54 and a rear wall 82 of the flange plate 53. The clearances on each side of the vane 21 are preferably minimal, but, in order for the vane 21 to be able to rotate between the adjacent structures, sufficient clearance must be provided. Thus, the clearance on each side of the vane (i.e. between the vane and the front wall 81, and between the vane and rear wall 82 on the other side thereof), is on the order of 0.01–0.015 inches. While this clearance is small, it is still sufficient to allow for a portion of the gas flowing between adjacent vanes 21 to be diverted into this space. If not controlled, this diversional gas flow may disrupt the flow of gas between adjacent vanes 21 as will now be explained.

Figure 11:
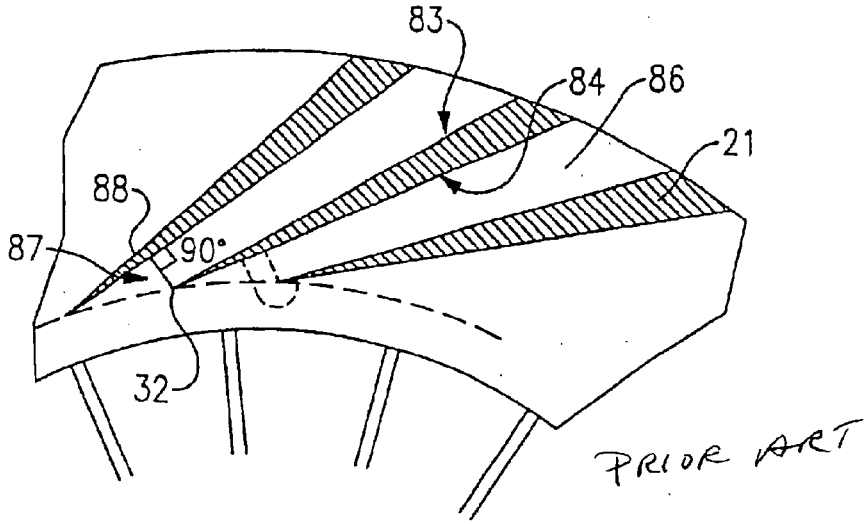
FIG. 11 is a schematic illustration of a portion of a diffuser apparatus, showing the throat of a channel.

FIG. 11 shows a typical vane diffuser having a plurality of vanes 21 with each vane 21 having a pressure surface 83 and a suction surface 84, with adjacent vanes defining a flow channel 86 therebetween. With such a diffuser, it is common nomenclature to define the throat 87 of the channel 86 between adjacent vanes 21 as that space with the smallest cross sectional area within the channel 86, or that area wherein a normal projection from a suction surface of one vane passes through the leading edge 32 of the adjacent vane 21 as shown in FIG. 11.

It has been found that a key fluid variable that impacts diffuser performance is throat boundary layer blockage. That is, if a pivot pin is located at a position 88 upstream of the throat 87 as shown in FIG. 11, that portion of the gas flowing through the channel that is temporarily diverted to flow into the space between the vane 21 and the front face 81 as shown and discussed with respect to FIG. 9, will be disrupted by the pivot pin 31 as it flow thereover to thereby create turbulence which, when it enters the throat 87 will create a boundary layer at the side of the throat to thereby significantly reduce performance levels of the diffuser. In accordance with one embodiment of the invention, these losses are reduced or eliminated by proper location of the pivot pin as will now be described.

Figure 12A:
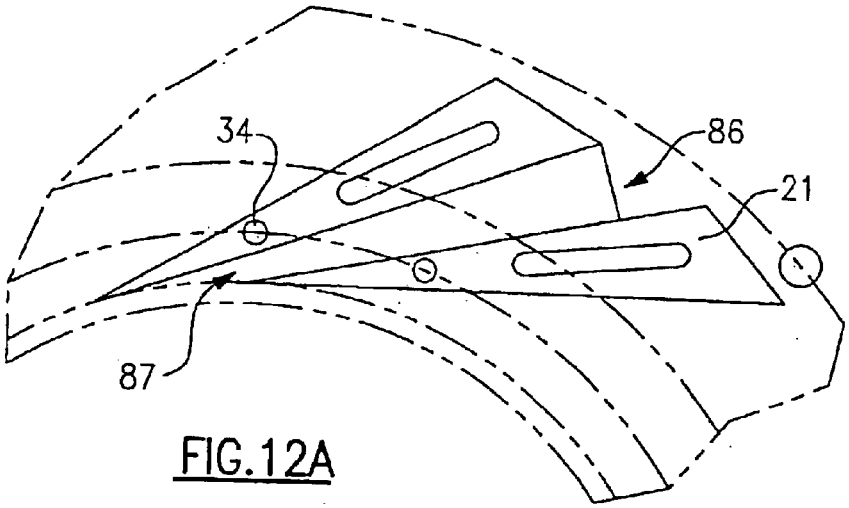
FIGS. 12*a* and 12*b* are partial axial views of the diffuser vanes showing the location of the pivot pin in accordance with the present invention.
Figure 12B:
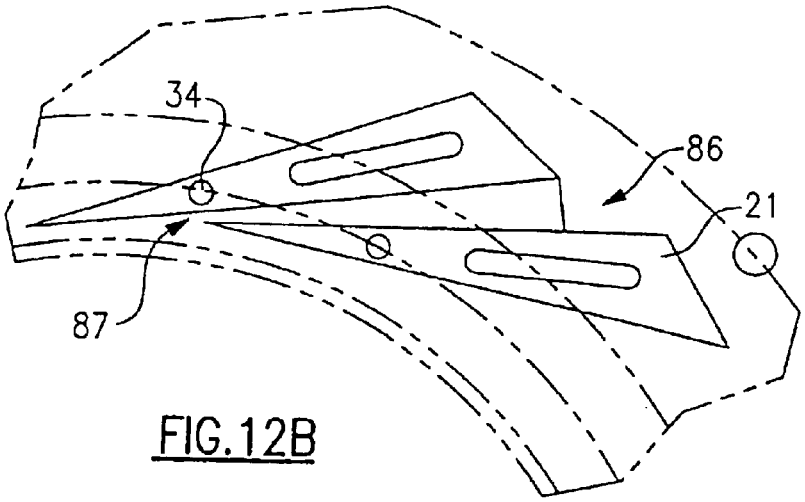

FIGS. 12*a* and 12*b* show a pair of adjacent vanes 21 in the fully opened and fully closed positioned respectively. In FIG. 12*a* it will be seen that the pivot pin 34 is located well downstream of the throat 87, and in FIG. 12*b*, although it is not as far downstream, the pin 34 is still downstream of the throat 87. For this reason, none of the flow stream passing through the throat 87 has been affected by the turbulence over the pivot pin 34. Although there will still be some flow over the pivot pin 34, with turbulence created in the channel 86 downstream of the pivot pin 34, this turbulence or boundary layer will not enter the throat 87 so as to reduce the performance of the diffuser.

While the present invention has been described with reference to a number of specific embodiments, it should be understood that the spirit and scope of the present invention is determined with reference to the appended claims.

We claim:

1. A vaned diffuser for a centrifugal compressor of the type having an impeller, said diffuser for receiving compressed gas from said impeller and converting the gas kinetic energy to higher pressure prior to its being passed onto a collector, comprising:

a diffuser housing;

a plurality of vanes, with each having a leading edge, a trailing edge, and a longitudinal axis extending from said leading edge to a point near said trailing edge;

mounting means for locating and retaining said plurality of vanes in said diffuser housing, with adjacent vanes defining a throat therebetween, said mounting means having associated with each of said plurality of vanes:

a pivot pin mounted in said diffuser housing near said vane leading edge and acting to position said vane within said housing, said pivot pin always being located downstream of the throat on the pressure side of the vane for all positions of said vane;

an actuation mechanism engaging said vane near its trailing edge, said mechanism being operable to selectively cause said vane to rotate about an axis of its pivot pin; and a slot in said vane, extending generally along said longitudinal axis to allow for relative movement, along said longitudinal axis, between said vane and said mounting means when said vane is rotated.

2. A vaned diffuser as set forth in claim 1 wherein said actuation mechanism comprises a shaft and an associated eccentric cam surface which engages said vane, with the shaft being rotatable to cause said vane to rotate.

3. A vaned diffuser as set forth in claim 1 wherein said pivot pin is integral with said vane.

4. A vaned diffuser as set forth in claim 2 wherein said slot is near said vane trailing edge and said cam surface is positioned in said slot.

5. A vaned diffuser as set forth in claim 1 wherein said pivot pin is positioned in said slot.

6. A vaned diffuser as set forth in claim 2 wherein said cam surface is round and is mounted in a round opening in said vane.

7. A vaned diffuser as set forth in claim 1 wherein said actuation mechanism comprises a ring which is interconnected to each of said vanes by way of actuation pins, and means for rotating said ring to move said plurality of vanes in substantial unison.

8. A vaned diffuser set forth in a claim 7 wherein said actuation pins are integral with said rotatable ring and are disposed in said vane slots.

9. A vaned diffuser as set forth in claim 8 wherein said vane slots are elongated to allow reciprocal movement between said actuation pins and said vanes.

10. A vaned diffuser as set forth in claim 7 wherein said actuation pins are integral with said rotatable ring and are disposed in openings in said vanes.

11. A vaned diffuser as set forth in claim 7 wherein said ring is rotatably mounted on an outer surface of an annular portion of said diffuser housing with no structure immediately surrounding its radially outer edge.

12. The vaned diffuser as set forth claim 11 wherein the radially outer edge of said ring is substantially radially aligned with said vane trailing edges.

13. A vaned diffuser for a centrifugal compressor having a housing and an impeller rotatably mounted therein for introducing compressed fluids to the inlet of said diffuser, wherein said diffuser comprises:

a plurality of circumferentially spaced vanes having radially inwardly disposed leading edges and radially outwardly disposed trailing edges with adjacent vanes defining passages for conducting the flow of compressed fluids therethrough, with each of said passages having a throat;

vane mounting means associated with each of said vanes for positioning said vanes within said housing and including a pivot pin disposed near said vane inlet and having an axis around which said vane is rotatable, said pivot pin always being located downstream of the throat on the pressure side of said vane for all positions of said vanes;

an actuation member engaged with each said vane near its trailing edge, said member being operable to selectively cause said vane to rotate about said pin axis; and a slot formed in each of said vanes for slideably receiving either said pivot pin or said actuation member so as to accommodate relative radial movement between said vane and said actuation member.

14. A vaned diffuser as set forth in claim 13 wherein said actuation member comprises a shaft and an associated eccentric cam surface which engages said vane, with the shaft being rotatable to cause said vane to rotate.

15. A vaned diffuser as set forth in claim 13 wherein said pivot pin is integral with said vane.

16. A vaned diffuser as set forth in claim 14 wherein said slot is near said vane trailing edge and said cam surface is disposed in said slot.

17. A vaned diffuser as set forth in claim 13 wherein said pivot pin is disposed in said slot.

18. A vaned diffuser as set forth in claim 14 wherein said cam surface is round and is mounted in a round opening in said vane.

19. A vaned diffuser as set forth in claim 13 wherein each of said actuation members are interconnected to a common ring which is selectively rotatable to move said plurality of vanes in substantial unison.

20. A vaned diffuser as set forth in claim 19 wherein said actuation members are integral with said ring and are located in said vane slots.

21. A vaned diffuser as set forth in claim 20 wherein said vane slots are elongated to allow reciprocal movement between said actuation members and said vanes.

22. A vaned diffuser as set forth in claim 19 wherein said ring is rotatably mounted on an outer surface of an annular portion of a diffuser housing with no structure immediately surrounding its radially outer edge.

23. A varied diffuser as set forth in claim 22 wherein the radially outer edge of said ring is substantially radially aligned with said vane trailing edges.

* * * * *

UNITED STATES PATENT AND TRADEMARK OFFICE

CERTIFICATE OF CORRECTION

PATENT NO. : 6,814,540 B2 
DATED : November 9, 2004
INVENTOR(S) : Vishnu M. Sishtla and Thomas M. Zinsmeyer It is certified that error appears in the above-identified patent and that said Letters Patent is hereby corrected as shown below:

Column 8,
Line 60, the word "varied" is incorrect please replace with the word -- vaned --.

Signed and Sealed this

Fifteenth Day of March, 2005

JON W. DUDAS
*Director of the United States Patent and Trademark Office*